United States Patent [19]

Dragagna et al.

[11] Patent Number: 4,493,132

[45] Date of Patent: Jan. 15, 1985

[54] DEVICE FOR CONDENSING THE FLEECE EMERGING FROM A CARDING ENGINE

[75] Inventors: Claudio Dragagna, Pavia; Claudio Locatelli, Capriolo, both of Italy

[73] Assignee: F. LLI Marzoli & C. S.p.A., Palazzolo Sull'Oglio, Italy

[21] Appl. No.: 439,540

[22] Filed: Nov. 5, 1982

[30] Foreign Application Priority Data

Nov. 5, 1981 [IT] Italy ..... 24886 A/81

[51] Int. Cl.[3] ..... D01G 15/46; D01H 5/72

[52] U.S. Cl. ..... 19/106 R; 19/288

[58] Field of Search ..... 19/106 R, 288, 159 R

[56] References Cited

U.S. PATENT DOCUMENTS

| | | | |
|---|---|---|---|
| 2,310,581 | 2/1943 | Garrett | 19/159 R |
| 2,810,936 | 10/1957 | Altenburger | 19/159 R |
| 3,196,492 | 7/1965 | Binder et al. | 19/106 R |
| 3,825,975 | 7/1974 | Staeheli | 19/106 R |
| 3,946,464 | 3/1976 | Meinke et al. | 19/106 R |
| 4,027,358 | 6/1977 | Llach et al. | 19/106 R |

FOREIGN PATENT DOCUMENTS

| | | | |
|---|---|---|---|
| 852972 | 11/1969 | Italy . | |
| 898309 | 3/1970 | Italy . | |
| 581851 | 10/1946 | United Kingdom . | |
| 897776 | 5/1962 | United Kingdom | 19/159 R |
| 1298855 | 12/1972 | United Kingdom . | |
| 2110257 | 6/1983 | United Kingdom | 19/106 R |

*Primary Examiner*—Louis K. Rimrodt

*Attorney, Agent, or Firm*—Holman & Stern

[57] ABSTRACT

A device for condensing a fleece emerging from a carding engine or a like machine has two adjoining and aligned sets of rollers (5, 5', 5'', 5''') having hollows along their generating lines and which are rotated about their own axes perpendicularly to the plane at which the fleece is doffed, and which are spaced apart relative to a fleece doffing roller (3). The rollers belonging to a set rotate in a direction and those of the adjoining set are rotated in the sense opposite to the former. The rotation of the rollers of two adjoining sets can be concordant in direction so as to provide a central doffing spot (13) between the two sets, or such a rotation can take place in directions opposite to one another and diverging, so as to provide two doffing spots (13,13') placed laterally of the two roller sets. By the rotation of such rollers two airstreams are originated, whereby the fleece is airborne and so conveyed towards the doffing spot(s) where a fibre sliver is formed to be forwarded to a condensing unit.

5 Claims, 5 Drawing Figures

DEVICE FOR CONDENSING THE FLEECE EMERGING FROM A CARDING ENGINE

This invention relates to a device for the condensation, with the formation of a sliver, of a fibre mass having the form of a fleece as drawn at the exit of a carding engine or a like machine.

More particularly, the present invention relates to a device for condensing the fleece at the exit of the doffing unit so as to shape it into a fibre sliver, in a carding engine for cotton, wool, and synthetic and man-made fibres.

It is known that in the conventional carding engines the fleece emerging from the doffing unit placed downstream of the doffing cylinder, is conveyed to the condensing funnel and passed between a couple of calendering rollers which convert it into a sliver, the latter being collected in cans thereafter for subsequent processing.

A certain distance exists between the fleece-doffing unit and the condensing funnel and such a distance is required to enable the fleece to enter said funnel with a certain evenness of its sliding motion and with a uniform distribution as far as practicable, the result being, however, that the fleece is subjected to a continuous shaking movement the intensity of which is a function of the speed at which the fleece is conveyed.

As a matter of fact, the higher is the speed at which the fleece emerges, the heavier is the drawing stress required for such a speedy conveyance, that which has an extremely detrimental bearing on the quality of the produced sliver. It should be recalled, moreover, that, if the draw which is required to produce a certain speed of conveyance exceeds a certain limiting magnitude, the fleece to be condensed becomes frayed so that variations in the count of yarn and sliver breakages are the result. Consequently, it is not permitted to exceed a certain conveyance speed in spite of the fact that the carding engine would be capable of providing a larger throughput.

In order that such shortcomings may be offset, devices have been provided which condense the fleece into slivers immediately downstream of the fleece-doffing unit.

Among these devices, for example, those disclosed in the Italian Pat. Nos. 852 972 and 898 309 are known, which provide, in combination with a couple of pressing rollers between which the fleece is fed forward, a couple of belts having a lap in tangential relationship with the peripheral surfaces of such cylinders of the couple, said tangent laps are displaced in opposite directions towards a central point at which the card sliver is discharged, as formed by the condensation in opposite directions of the two card fleece halves.

In addition, the Italian Pat. No. 898 309 even provides a single belt, still having a lap tangent to the cylinder couple with a discharge of the card sliver in a lateral position. Instead of said belt, provision could also be made for using a roller set tangentially oriented relative to the cylinder couple in question.

The drawbacks experienced with the devices aforementioned are the following:

the belts must continually be held taut so as to achieve both a regular motion and a uniform conveyance of fibres: if not so, in fact, serious troubles would be experienced as to the quality of the fleece and thus of the sliver and, on the top of that, this shortcoming involves an additional upkeep expenditure and a worsening of the machine efficiency;

the feeding mechanism is comprised of a couple of pressing cylinders which clear the fleece and, inasmuch as the belt lap is tangent to the said couple, it acts like a clearer so that all the impurities are dragged towards the exit end and reach the card sliver so that the quality of the latter is worsened together with that of the final product, i.e. the yarn;

variations of the count of yarn of the card sliver can be experienced because the superposition of the fibres to compose the yarn concerned may become irregular due to the different speed of conveyance thereof, inasmuch as the fibres which are close to the belt couples go faster than those which are far away.

Consequentially, an objective of the present invention is to provide a device for condensing a fibre fleece, with the formation of a sliver, or a tow, and more particularly to provide a device intended for condensing the card fleece at the exit of the fleece-doffing unit in carding engines, which is exempt from the defects aforementioned.

This objective is attained, according to the present invention, by a device for condensing the fleece emerging from the outlet end of a carding machine for cotton, wool, synthetic and man-made fibres by a fleece-doffing unit comprising a doffing roller, characterized in that the fleece drawn from said fleece-doffing unit is conveyed to at least a point of discharge for the formation of a sliver, airborne and so conveyed in and by at least two air streams, placed substantially on the plane of discharge and parallel to the doffing cylinder of said fleece-doffing unit, said air streams being directed in opposite directions and generated by the rotation of a plurality of spaced apart rollers having substantially concave surfaces along their generating lines about their respective axes substantially perpendicular to said plane on which they are arranged substantially in two aligned and adjoining sets which are spaced apart parallely of said doffing cylinder.

The fleece-doffing unit is conventional in and as itself and can consist, for example, of a splined cylinder, or a knurled or embossed cylinder, and of a doffing comb tangent to said cylinder.

The substantially concave roller elements, arranged according two aligned and adjoining sets, parallel to and spaced apart from the doffing cylinder of the fleece-doffing unit, on the discharge plane of which they are substantially arranged, are comprised of a plurality of cylindrical bodies substantially hollowed out along a hyperboloid generating line, very much in the fashion of a pulley having a wide and belled out throat. They are arranged in mutual alignment and are spaced apart on the doffing plane of the cylinder of the doffing unit, and at an appropriate spacing from, and parallel to, the doffing cylinder of said fleece-doffing unit. Such a distance may vary consistently with the nature of the fibres, the machine size and other factors, but it must suffice, at any rate, to allow for a free sliding motion of the airborne fibres floating in the air streams originated by the rotation of the elements concerned.

The elements in question, moreover, according to an essential aspect of the present invention, are rotated about axes which are mutually parallel and are perpendicular to said doffing plane of the doffing cylinder of the fleece-doffing unit, and are driven by conventional motive means such as motors, pulleys, gears and others as will be seen in the accompanying drawings.

As outlined above, the roller elements of concave outline are marshalled according to at least two sets which are mutually aligned and adjoining, and parallel to the doffing cylinder of the fleece-doffing unit, whereas the individual elements of each set are rotated about the respective axes concordantly relative to one another but in a direction which is opposite with respect to the direction of rotation of the elements belonging to the other adjoining set.

Thus, the rotation of the elements which compose each set can be caused to take place concordantly between two adjoining sets, directed towards at least a discharge spot centrally positioned relative to both sets, in correspondence with which the sliver card is formed and discharged: as an alternative, the directions of rotation of the elements of two adjoining sets can be caused to take place both contrarily and divergently and in this latter case two lateral discharge locations will be provided.

The rotary motion of the hollowed-out roller elements originates the formation of an air stream which is more or less speedy consistently with the speed of rotation, so that the card fleece exiting the fleece-doffing unit cylinder is subjected to the action of two air streams which are parallel to the cylinder in question and flow in opposite directions, so that the fleece is airborne by the air stream and conveyed thereby towards the central discharge point between the two hollowed-out roller element sets if their directions of rotation are contrary to one another, or, as an alternative, towards two lateral discharge locations if the directions of rotation are contrary to one another in the two adjoining element sets.

This latter approach finds an elective application in the case of carding engines having a comparatively wide working width, such as a width exceeding one meter.

The fleece is thus converted into a sliver without undergoing any contact with the rotary elements, with a fully conspicuous advantage in connection with the evenness of the sliver and the smoothness of processing, inasmuch as no effect of skidding and/or friction of the fibres on moving mechanical component parts is experienced, just the contrary of what occurred in the conventional procedures heretofore.

Lastly, the surface speed of the rotary members is adjusted to values which are at least the same as those taken by the speed of the doffing unit cylinder, until taking, for example, a value equal, for example to 1.8 times that of the doffing unit cylinder.

Further features and advantages of the invention will become apparent from the disclosure of practical embodiments thereof as illustrated by way of nonlimiting examples, in the accompanying drawings, wherein.

Figure 1:
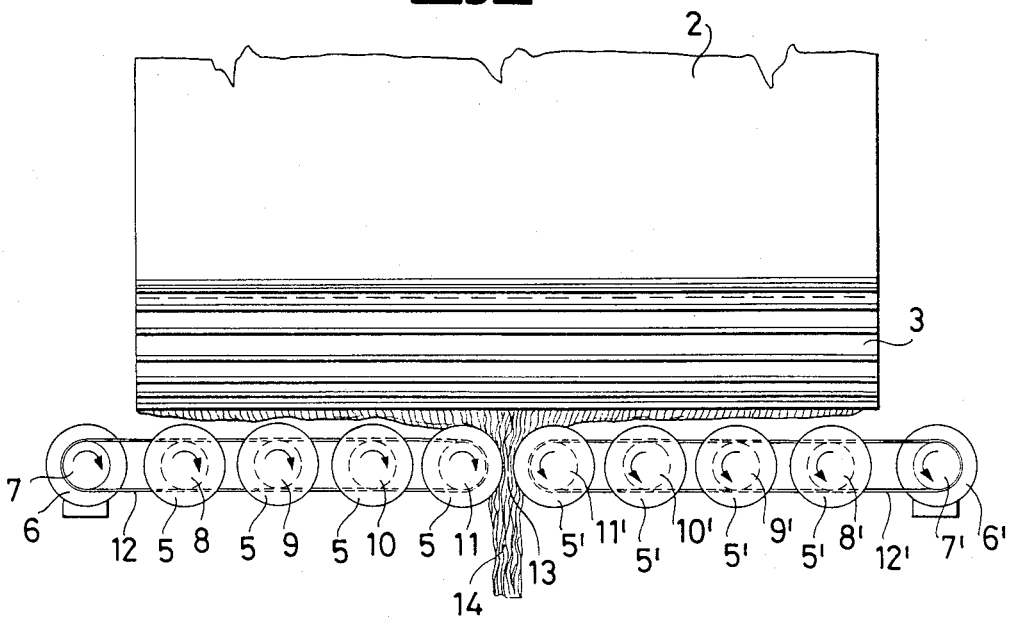
FIG. 1 is a plan view of the device according to this invention.
Figure 2:
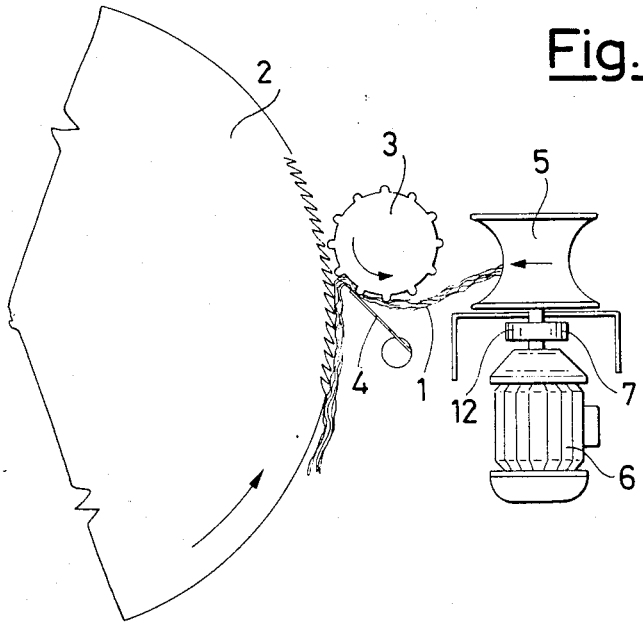
FIG. 2 is a front view of the device according to the invention.

FIGS. 1 and 2 show in plan view and in front view, respectively, the device for condensing the fleece at the exit end of a carding engine, according to the invention, wherein the fleece 1 is doffed from the doffing cylinder 2 by the action of a conventional doffing comb consisting of the splined roller 3 which is rotated contrarywise relative to the cylinder 2 and by the blade 4 tangent to the splined cylinder 3.

At a certain distance apart from the fleece-doffing unit there are arranged two aligned and adjoining sets of concave roller elements 5 and 5', spaced apart from one another and from the doffing cylinder, and with their axes perpendicular to that of the splined cylinder 3 and to the fleece discharge plane, and which are driven to rotate about driving units comprised of two motors 6 and 6' and by pulleys 7, 8, 9, 10, 11, 7', 8', 9', 10' 11' and two belts 12 and 12'.

It should be noted that the motor 6 causes the concave elements 5 to be rotated clockwise, whereas the motor 6' causes the elements 5' to be rotated counterclockwise, and, moreover, the surface speed of the elements 5 and 5' is equal to or more than that of the doffing cylinder 2 or the splined cylinder 3, the ratio of the two respective speeds of rotation being between 1:1 and 1.80:1.

The operation of the device according to the invention is as follows.

At the start and for a few instants of time, the carding engine runs at a reduced speed so that the fleece 1 emerges from the splined cylinder 3 and the blade 4 slowly and stretches itself out onto the concave elements 5 and 5', these latter being also rotated at a low speed, and is fed forward towards the central point 13 and emerges automatically by being converted into a sliver 14 to be sent to the condensing unit, the latter being not shown.

At the steady state speed of the machine all the component parts are rotated swiftly so that also the concave elements 5 and 5' are swiftly rotated about their axes and drive a certain volume of air thus generating at the side facing the doffing cylinder 2 two mutually conflicting air streams which flow in opposite directions parallely of the axis of the doffing cylinder 2 and the splined cylinder 3, so that the fleece, onto which both streams impinge, is airborne and driven towards the central discharge point 13 to form a sliver 14, without contacting any of the concave elements 5 and 5' so that any sliding and/or frictional motion of the fibres is thereby prevented.

Figure 3:
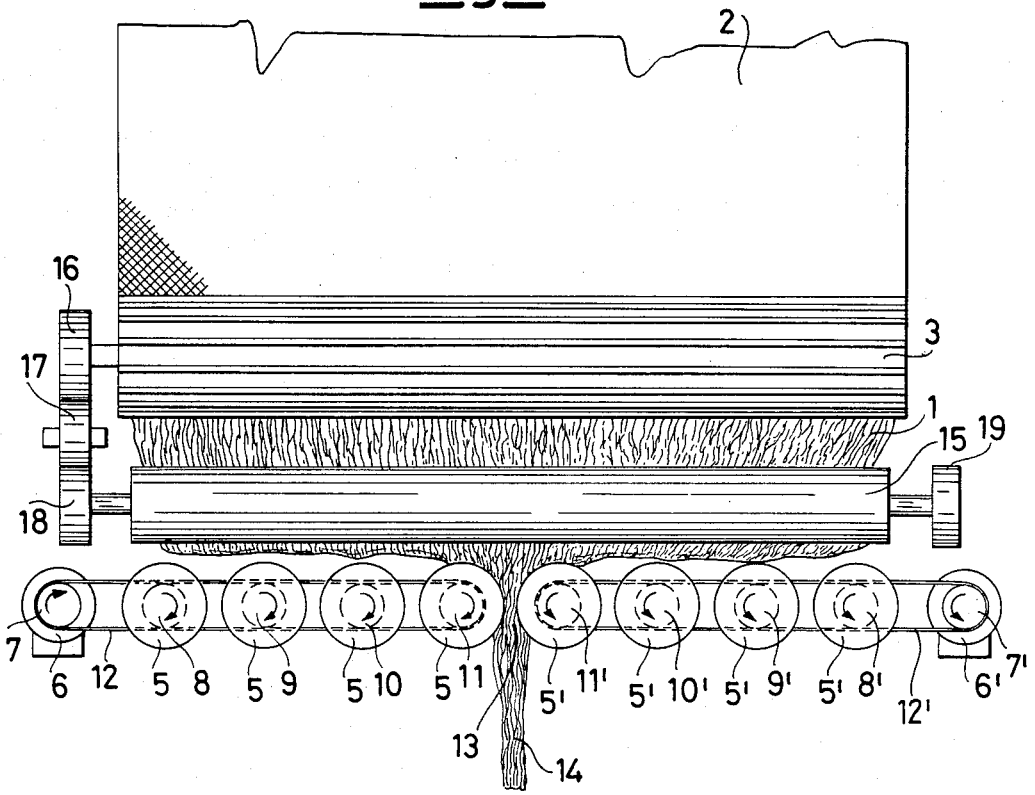
FIG. 3 is a plan view of the device as applied at the exit end of a couple of pressing cylinders.

The fleece-condensation device according to the invention could also be applied to the exit end of a couple of pressing cylinders 15, as shown in FIG. 3.

The gears 16, 17, 18 and 19 are intended to drive to rotation the couple of cylinders 15 (only the top cylinder can be seen in FIG. 3 arranged between the doffing cylinder 2 and the roller elements 5,5'. The latter are spaced apart from the pressing cylinders 15.

Figure 4:
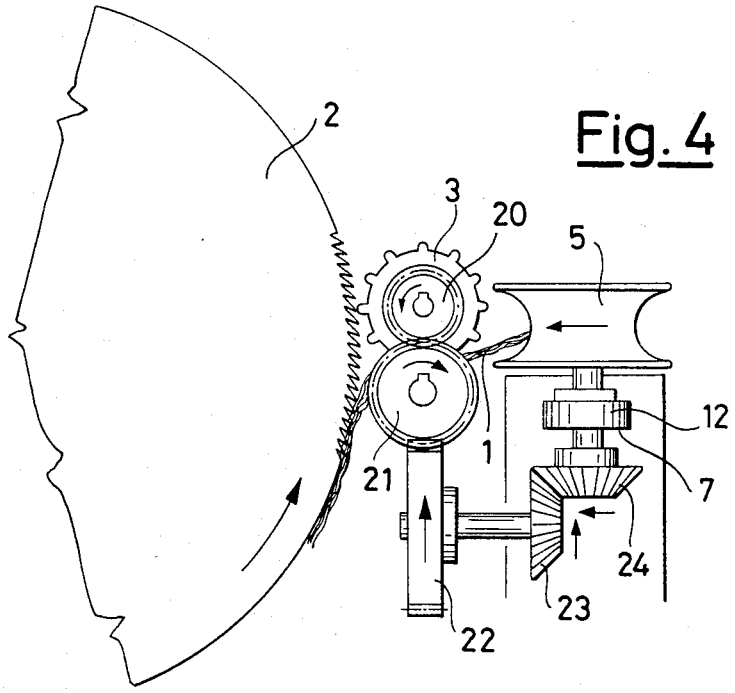
FIG. 4 is a front view of the device in which the rotary concave elements are driven by the rotation of the doffing cylinder.

FIG. 4 is a front view of the device according to the invention, wherein the rotary motion of the concave elements 5 and 5' is taken from the splined cylinder 3 via the gears 20, 21, 22, 23 and 24.

Figure 5:
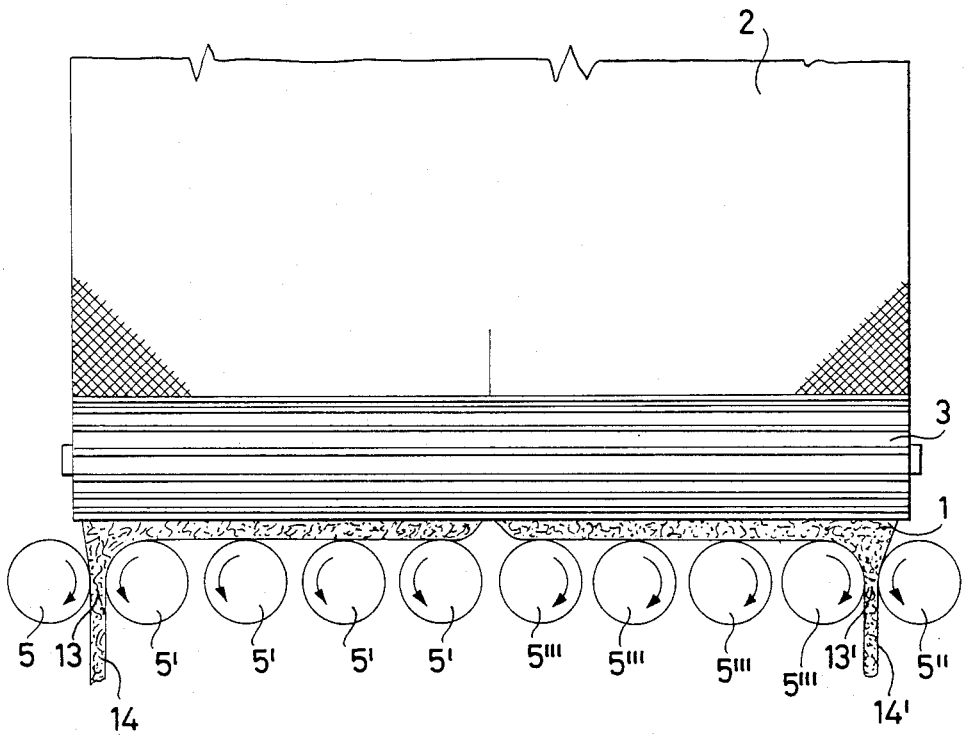
FIG. 5 is a plan view of the device having a plurality of exits for the card sliver.

FIG. 5 shows the device according to the invention as having two exits for the sliver and can be applied to carding engines in which the processing width exceeds one meter.

In this case, two sets of concave elements 5' and 5''' respectively, are rotated contrarywise relative to one another and divergently at the side of the doffing cylinder so that one half of the fleece is conveyed towards a lateral discharge point 13 and a sliver 14 is thus formed, whereas the second half of the fleece is conveyed towards a lateral discharge point 13' on the opposite side and a second sliver 14' is formed. It should be noted that the end concave elements of the two element sets 5' and 5''' cooperate with concave elements, 5 and 5'', respectively, which are rotated contrarywise relative to one another, as can clearly be seen by viewing the arrows in FIG. 5.

We claim:

1. A device for condensing a fleece taken at an exit of a carding engine for cotton, wool, synthetic and man-made fibres by a fleece-doffer comprising a doffing cylinder, wherein the fleece taken from said fleece-doffer is conveyed to at least one discharge point for the formation of a sliver, comprising means for generating at least two air streams substantially parallel to the axis of said doffing cylinder in opposite directions on a fleece-discharge plane passing through said at least one discharge point, said means comprising a plurality of roller elements rotatably driven about respective axes arranged perpendicularly to said discharge plane, said roller elements having a substantially concave lateral configuration and being arranged in at least two aligned and adjoining sets spaced apart parallely to said doffing cylinder and spaced therefrom, so that said fleece is conveyed by said air streams without contacting said roller elements.

2. A device according to claim 1, wherein the roller element of one of said sets are rotated in a direction opposite to that of the roller element of the other of said sets, the direction of rotation being such as to generate at the side facing said doffing cylinder air streams directed towards at least one central discharge zone.

3. A device according to claim 1, wherein the roller elements of one of said sets are rotated in a direction opposite to that of the roller elements of the other of said sets, the direction of rotation being such as to generate at the side facing said doffing cylinder air streams directed in diverging directions towards two discrete lateral discharging zones.

4. A device according to claim 1, wherein the peripheral speed of said roller elements is at least equal to that of said doffing cylinder.

5. A device according to claim 1, wherein a pair of pressing cylinders is arranged between said doffing cylinder and said sets of roller elements, the sets of roller elements being spaced apart from said pressing cylinders.

* * * * *